US006268690B1

(12) United States Patent
Yamazaki

(10) Patent No.: US 6,268,690 B1
(45) Date of Patent: Jul. 31, 2001

(54) COLOR CATHODE RAY TUBE WITH FACE PANEL AND SHADOW MASK HAVING CURVED SURFACES THAT MEET SPECIFIED RELATIONSHIPS

(75) Inventor: Tatsuya Yamazaki, Miyagi-ken (JP)

(73) Assignee: Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/180,825

(22) PCT Filed: Mar. 12, 1998

(86) PCT No.: PCT/JP98/01044

§ 371 Date: Nov. 12, 1998

§ 102(e) Date: Nov. 12, 1998

(87) PCT Pub. No.: WO98/42004

PCT Pub. Date: Sep. 24, 1998

(30) Foreign Application Priority Data

Mar. 14, 1997 (JP) ..... 9-060285

(51) Int. Cl.[7] ..... H01J 29/10; H01J 31/00; H01J 29/80

(52) U.S. Cl. ..... 313/461; 313/477 R; 313/402; 313/408

(58) Field of Search ..... 313/402, 407, 313/408, 461, 477 R; 220/2.1 R, 2.1 A, 2.3 A, 2.3 R

(56) References Cited

U.S. PATENT DOCUMENTS

| | | | | |
|---|---|---|---|---|
| 4,677,339 | * | 6/1987 | Inoue et al. | 313/402 |
| 4,697,119 | * | 9/1987 | Inoue et al. | 313/408 |
| 4,943,754 | | 7/1990 | Hirai et al. | 313/477 |
| 5,155,410 | | 10/1992 | Wakasono et al. | 313/402 |
| 5,274,303 | | 12/1993 | Bakker et al. | 313/477 |
| 5,319,280 | | 6/1994 | Vriens | 313/413 |
| 5,506,470 | | 4/1996 | Inoue et al. | 313/477 |
| 5,631,520 | * | 5/1997 | Inoue et al. | 313/402 |

FOREIGN PATENT DOCUMENTS

| | | |
|---|---|---|
| 41 09 855 | 10/1991 | (DE) . |
| 2 136 198 | 9/1984 | (GB) . |
| 2 136 199 | 9/1984 | (GB) . |
| 2 147 142 | 5/1985 | (GB) . |
| 2 243 945 | 11/1991 | (GB) . |
| 6-85303 | 10/1994 | (JP) . |
| 7-153385 | 6/1995 | (JP) . |
| 7-111876 | 11/1995 | (JP) . |
| 2534644 | 6/1996 | (JP) . |

* cited by examiner

*Primary Examiner*—Michael H. Day
*Assistant Examiner*—Mack Haynes
(74) *Attorney, Agent, or Firm*—Pillsbury Winthrop LLP

(57) ABSTRACT

An inner surface of an effective portion (10) of a substantially rectangular panel is formed to be a curved surface which satisfies relationships of RyP1<PyP0, RyP1<RyPH, RyP1<½·RyP2 and RyP2<3·RyP1, where RyP0 is a radius of curvature of the inner surface in a short axis direction thereof at the center of the effective portion (10), RyPH is a radius of curvature of the inner surface in the short axis direction at an end of a long axis of the effective portion (10), RyP1 is a radius of curvature of the inner surface in the short axis direction at a position within a range of 7/16·WPH to ¼·WPH from the center of the effective portion in the long axis direction, wherein WMH is a width of the effective surface in a long axis direction thereof, and RyP2 is a radius of curvature of the inner surface in the short axis direction at an end of the effective portion on a line parallel to the short axis passing through the position on the long axis within a range of 7/16·WPH to ¼·WPH from the center of the effective portion.

3 Claims, 2 Drawing Sheets

COLOR CATHODE RAY TUBE WITH FACE PANEL AND SHADOW MASK HAVING CURVED SURFACES THAT MEET SPECIFIED RELATIONSHIPS

This application is the national phase of international application PCT/JP98/01044 filed Mar. 12, 1998 which designated the U.S.

TECHNICAL FIELD

The present invention relates to a color cathode ray tube, and particularly, to a color cathode ray tube which restricts deterioration of color purity caused by thermal expansion of a shadow mask.

BACKGROUND ART

In general, a color cathode ray tube has a substantially rectangular panel including an effective portion having a curved inner surface. A phosphor screen consisting of a three-color phosphor layer is provided in the effective portion of the panel. The color cathode ray tube is provided with a mask body and a shadow mask provided in the periphery of the mask body. The mask body is arranged apart from the phosphor screen by a predetermined distance or so-called q-value and has an effective surface in form of a curved surface, which is opposed to the phosphor screen and having a number of electron beam apertures formed therein. In a color cathode ray tube having a structure as described above, three electron beams emitted from an electron gun assembly provided in a neck of a funnel are deflected by a deflector and are subjected to a selection by the shadow mask such that three electron beams correctly enter into the three-color phosphor layer. The phosphor screen is thus scanned with the electron beam and a color image is displayed on the phosphor screen.

In the field of color cathode ray tubes having a structure as described above, it is a main trend to adopt an inline type color cathode ray tube using three-guns as an electron gun assembly, which emits three electron beams arranged in line to pass through one same plane.

In general, only ⅓ or less of electron beams emitted from the electron gun pass through electron beam apertures of a shadow mask and enter into the phosphor screen while the rest of the electron beams collide into the shadow mask. Therefore, the shadow mask is heated to 80° C. or more in several cases. If the shadow mask is thus heated, and particularly, if the mask body is made of a rolled plate having a thickness of about 0.1 to 0.3 mm and a high thermal expansion coefficient and if a mask frame installed at a peripheral portion of the mask body is made of a rolled plated having a thickness of about 1 mm, so-called doming is caused and the thin mask body 1 made of a thin rolled plate expands toward a phosphor screen 2, as shown in FIG. 1, and the distance (or q-value) between the inner surface of an effective portion 4 of a panel 3 and an effective surface of the mask body 1 exceeds a tolerable range, thereby causing deterioration of color purity.

In the doming of the shadow mask 5, two types of doming are caused, one being doming in which the center portion of the mask 1 expands toward the phosphor screen 22 because the mask body 1 is mainly heated and the heat of the peripheral portion of the mask body 1 transfers to the mask frame 6 having a large heat capacity, and the other being localized doming caused by collision of a high-density electron beam 7 for displaying a localized high luminance image as indicated by a one-dot chain line. In particular, deterioration of color purity due to the localized doming easily occurs in the vicinity of a position on the long axis direction of the mask body 1, which is distant from the center of the effective surface of the mask body 1, by about ⅓ of the long axis.

As described above, in a color cathode ray tube, a shadow mask is heated due to collisions of electron beams emitted from an electron gun to cause doming in which a mask body having a small thickness expands toward the phosphor screen, so that the distance between the inner surface of an effective portion of the panel and an effective surface of the mask body exceeds a tolerable range, thereby causing deterioration of color purity. As for the doming, two types of doming are caused, one being doming in which the center portion of the mask expands toward the phosphor screen because the mask body is mainly heated and the heat of the peripheral portion of the mask body is transferred to a mask frame having a large heat capacity, and the other being doming which is caused due to collisions of high-density electron beams for displaying a localized high-luminance image. In particular, there is a problem that deterioration of color purity due to localized doming easily occurs in the vicinity of a position on the long axis of the mask body, which is distant from the center of the effective surface of the mask body by ⅓ of the width of the mask body in the long axis direction.

DISCLOSURE OF INVENTION

An object of the present invention is to provide a color cathode ray tube which is difficult to cause deterioration of color purity, by forming a mask body of a shadow mask in form of a curved surface which minimizes localized doming and by setting the shape of the inner surface of an effective portion of a panel so as to maintain a predetermined distance between the panel and the mask body.

According to the present invention, there is provided a color cathode ray tube comprising: a rectangular panel including an effective portion having an inner surface in form of a curved surface; a phosphor screen provided on the inner surface of the panel; and a substantially rectangular shadow mask provided to be opposed to the phosphor screen, characterized in that the inner surface of the effective portion of the panel has radiuses of curvature in a short axis direction of the inner surface, at arbitrary positions in the inner surface, and the radiuses of curvature are defined to be smallest at an intermediate portion distant from a center of the effective portion by a distance ranging from $\frac{7}{16}\cdot WPH$ to $\frac{1}{4}\cdot WPH$ where WPH is a width of the effective portion in a long axis direction of the effective portion.

Also, according to the present invention, there is provided a color cathode ray tube comprising: a rectangular panel including an effective portion having an inner surface in form of a curved surface; a phosphor screen provided on the inner surface of the panel; and a substantially rectangular shadow mask provided to be opposed to the phosphor screen, characterized in that the inner surface of the effective portion is formed in a curved surface which satisfies relationships of $RyP1<PyP0$, $RyP1<RyPH$, $RyP1<\frac{1}{2}\cdot RyP2$, and $RyP2<3\cdot RyP1$, where RyP0 is a radius of curvature of the inner surface in a short axis direction thereof at the center of the effective portion, RyPH is a radius of curvature of the inner surface in the short axis direction at an end of a long axis of the effective portion, WPH is a width of the effective portion of the effective portion, RyP1 is a radius of curvature of the inner surface of the effective portion of the panel in the short axis direction at a position which is on a line parallel to a short axis of the effective portion and which passes through an intermediate portion distant from a center of the effective portion by a distance ranging from 7/16·WPH to 1/4·WPH in the long axis direction, and RyP2 is a radius of curvature of the inner surface in the short axis direction at an end of the effective portion on a line which is parallel to the short axis and which passes through a position distant by a distance ranging from 7/16·WPH to 1/4·WPH in the long axis direction.

Further, according to the present invention, there is provided a color cathode ray tube comprising: a rectangular panel including an effective portion having an inner surface in form of a curved surface; a phosphor screen provided on the inner surface of the panel; and a substantially rectangular shadow mask provided to be opposed to the phosphor screen and having an effective surface in form of a curved surface opposed to the phosphor screen, characterized in that the inner surface of the effective portion of the panel has radiuses of curvature in a short axis direction of the inner surface, at arbitrary positions in the inner surface, and the radiuses of curvature are defined to be smallest at an intermediate portion distant from a center of the effective portion by a distance ranging from 7/16·WPH to 1/4·WPH where WPH is a width of the effective portion in a long axis direction of the effective portion, and that the effective surface of the shadow mask is formed in form of a curved surface corresponding to a shape of the inner surface of the panel.

BEST MODE OF CARRYING OUT THE INVENTION

In the following, an embodiment of a color cathode ray tube according to the present invention will be explained with reference to the drawings.

Figure 1:
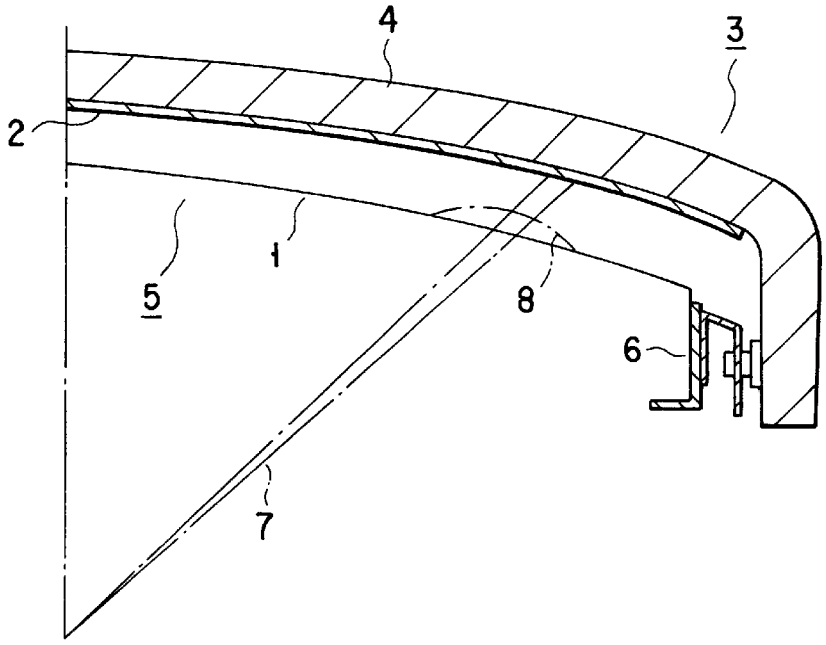
FIG. 1 is a view for explaining localized doming of a shadow mask in a conventional color cathode ray tube.
Figure 2:
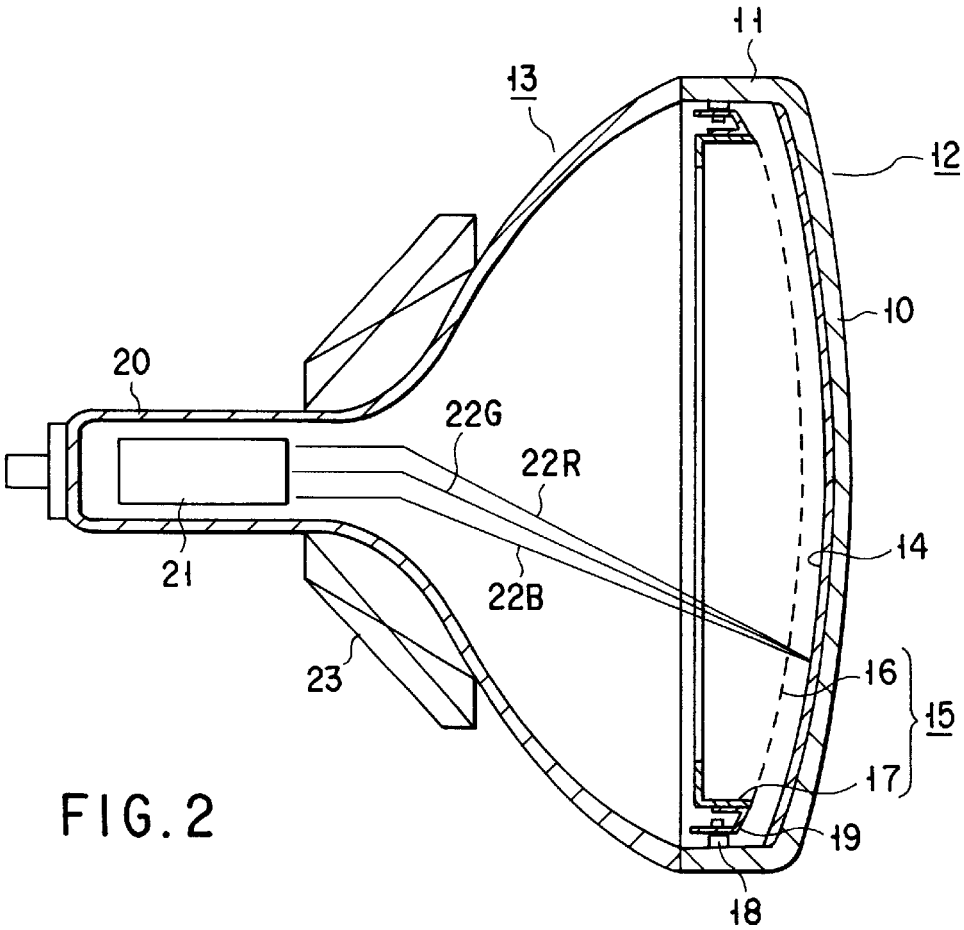
FIG. 2 is a cross-sectional view schematically showing a color cathode ray tube as an embodiment of the present invention.

FIG. 1 schematically shows a color cathode ray tube according to an embodiment of the present invention. The color cathode ray tube has an envelope consisting of a substantially rectangular panel 12 provided with a skirt portion 11 at a peripheral portion of an effective portion made of a curved surface, and a funnel 13 connected to the skirt portion 11 of the panel 12. A phosphor screen 14 consisting of a three-color phosphor layer which emits blue, green, and red light rays is provided on the surface of the effective portion 10, and a substantially rectangular shadow mask 15 is provided insides to be apart from the phosphor screen 14 by a predetermined distance. The shadow mask 15 consists of a substantially rectangular mask body 16 having an effective surface, which is made of a curved surface opposed to the phosphor screen 14 and has a number of electron beam apertures formed in the effective surface, and a substantially rectangular mask frame 17 equipped at a peripheral portion of the mask body 16. The shadow mask 15 is supported by a plurality of stud pins 18 provided at the skirt portion 11 of the panel 12, and by a plurality of elastic support members 19 installed on the mask frame 17 and engaged with the stud pins 18. Meanwhile, an electron gun 21 is provided in the neck of the funnel 13. Further, three electron beams 22B, 22G, and 22R emitted from the electron gun 21 are deflected by a deflector 23 equipped outside the funnel 13, and are subjected to a selection by the shadow mask 15 so as to correctly enter into the three-color phosphor layer. The phosphor screen 14 is scanned horizontally and vertically with the electron beams, thereby displaying a color image onto the phosphor screen 14.

Figure 3:
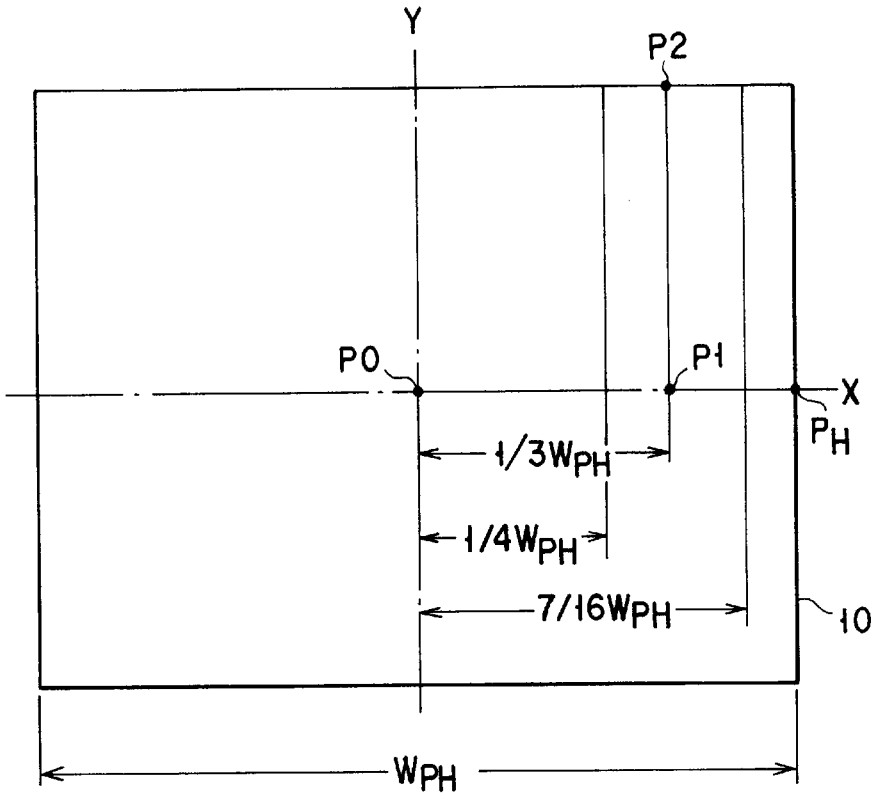
FIG. 3 is a view for explaining the shape of the inner surface of an effective portion of a panel of the color cathode ray tube shown in FIG. 1.

In the color cathode ray tube, the inner surface of the effective portion 10 of the panel 12, which is shown in FIG. 3, is formed in form of a curved surface which satisfies relationships expressed as described below. The effective portion 10 of the panel 12 means an area on the inner surface of the panel 12, which is scanned with electron beams to display an effective image on the phosphor screen 14. In the relationships described below, RyP0 is a radius of curvature in the short axis (or Y-axis) direction, at the center P0 of the effective portion 10; RyPH is a radius of curvature in the short axis direction, at an end PH of the long axis (or X-axis) of the effective portion 10; RyP1 is a radius of curvature in the short axis direction, at an intermediate portion distant from the center P0 of the effective surface by a distance ranging from 7/16·WPH to 1/4·WPH where WPH is a width of the effective surface in the long axis direction, e.g., at a position P1 on the long axis which is distant by 1/3·WPH; and RyP2 is a radius of curvature in the short axis direction at an end P2 of the effective portion on a line parallel to the short axis passing through the position P1 on the long axis.

$RyP1<RyP0$ $RyP1<RyPH$ $RyP1<\frac{1}{2}\cdot RyP2$ $RyP2<3\cdot RyP1$

Figure 4:
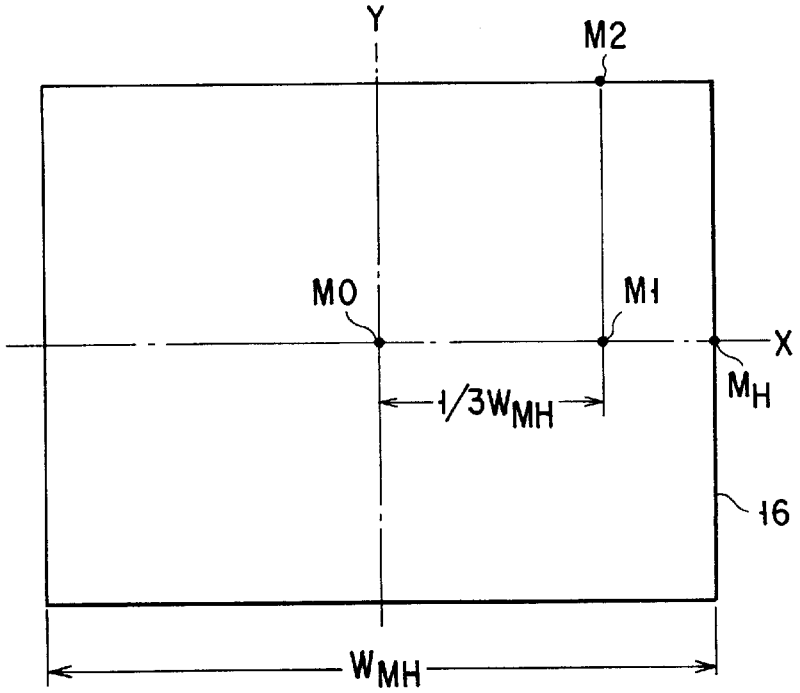
FIG. 4 is a view for explaining the shape of the effective surface of an effective portion of a shadow mask of the color cathode ray tube shown in FIG. 1.

Further, the effective surface of the mask body 16 of the shadow mask 15 opposed to the phosphor screen 14, which is shown in FIG. 4, is formed in a curved surface which is defined by the following relationships in correspondence with the shape of the inner surface of the effective portion 10 of the panel 12. The effective surface of the mask body 16 corresponds to the area of the mask 16, which is scanned with electron beams reaches the effective portion of the panel 12. In the following relationships, RyM0 is a radius of curvature in the short axis (or Y-axis) direction at the center M0 of the effective surface of the mask body 16; RyMH is a radius of curvature in the short axis direction at an end MH of the long axis (or X-axis) of the effective portion 10, RyM1 is a radius of curvature in the short axis direction at an intermediate portion distant from the center M0 of the effective surface by a distance ranging from 7/16·WMH to 1/4·WMH where WMH is a width of the effective surface in the long axis direction, e.g., at a position M1 distant by 1/3·WMH; and RyM2 is a radius of curvature in the short axis direction, at an end M2 of the effective area on a line which is parallel to the short axis and passes through the position M1 on the long axis.

$RyM1<RyM0$ $RyM1<RyMH$ $RyM1<RyM2$

Examples of an inner surface of an effective portion 10 of the panel 12 and a shape of the curved surface of the mask body 16 are shown in Table 1 compared with a conventional 34-inch color cathode ray tube.

TABLE 1

| | PO,MO | P1,M1 | P2,M2 | PH,MH |
|---|---|---|---|---|
| Embodiment | | | | |
| Radius of curvature of inner surface of effective portion of panel in short axis direction (mm) | 1290 | 1100 | 3000 | 1350 |
| Radius of curvature of effective surface of mask body in short axis direction (mm) | 1330 | 1200 | 1650 | 1430 |
| Prior Art | | | | |
| Radius of curvature of inner surface of effective portion of panel in short axis direction (mm) | 1360 | 1340 | 1340 | 1550 |
| Radius of curvature of effective surface of mask body in short axis direction (mm) | 1510 | 1470 | 1230 | 1590 |

As shown in Table 1, in case of a conventional color cathode ray tube, the above-mentioned three formulas concerning the panel are as follows.

RyP1(1340 mm)<RyP0(1360 mm)

RyP1(1340 mm)<RyPH(1550 mm)

RyP1(1340 mm)=RyP2(1340)<½·RyP2

In case of a color cathode ray tube according to the present embodiment, the three formulas are as follows.

RyP1(1100 mm)<RyP0(1290 mm)

RyP1(1100 mm)<RyPH(1350 mm)

RyP1(1340 mm)<½·RyP2(1500 mm)

RyP2(3000 mm)<3·RyP1(3300 mm)

Further, in case of a conventional color cathode ray tube, RyM1 is greater than RyM2 as for the effective surface of the mask body 12.

RyM1(1470 mm)<RyM0(1510 mm)

RyM1(1470 mm)<RyMH(1510 mm)

RyM1(1470 mm)<RyM2(1230 mm)

In case of a color cathode ray tube according to the present embodiment, RyM1 and RyM2 constitute an opposite relationship, and the radius of curvature RyM1 in the short axis direction at an intermediate portion distant from the center M0 of the effective surface by a distance ranging from 7/16·WMH to ¼·WMH, e.g., at a position distant by ⅓·WMH on the long axis is smaller than the radius of curvature in the short axis direction at another portion.

RyM1(1200 mm)<RyM0(1330 mm)

RyM1(1200 mm)<RyMH(1430 mm)

RyM1(1200 mm)<RyM2(1650 mm)

Thus, if the inner surface of the effective surface of the panel 12 is formed in a particular curved surface, the effective surface of the mask body 16 can be maintained at a distance in a tolerable range, from the inner surface of the effective portion 10, so that the radius of curvature RyM1 in the short axis direction at an intermediate portion which is distant from the center M0 of the effective surface by a distance ranging from 7/16·WMH to ¼·WMH, e.g., at a position distant by ⅓·WMH on the long axis and which most easily causes localized doming, can be smaller than the radius of curvature in the short axis direction at another portion. As a result, a shadow mask which is difficult to cause doming can be obtained, so that a color cathode ray tube which is difficult to cause deterioration of color purity can be constructed.

In this case, even if RyP2 is formed so as to exceed a relationship of RyP2<3·RyP1 where RyP2 is the radius of curvature in the short axis direction at the end P2 of the effective area on a line which is parallel to the short axis and passes through the point P1 on the long axis of the effective portion 10 of the panel 12, the distance between the inner surface of the effective portion 10 of the panel 12 and the effective surface of the mask body 16 can be maintained-:within a tolerable range, and it is possible to construct a mask body 16 which is difficult to cause localized doming. However, if the radius of curvature in the short axis direction at the end P2 of the effective portion is set to RyP2 or more, the radius of curvature in another direction than the short axis direction at the end P2 of the effective portion becomes too large, so that the panel 12 easily cause problems such as a decrease in are-pressure resistance at the end P2 of the effective portion and large purity drifting at a position other than the position P1.

Table 2 shows a movement amount of a position at which the electron beam is incident on the phosphor screen, obtained as a result of generating a high-density electron beam to forcedly cause localized in the vicinity of the position M1 on the long axis, apart from the center M0 of the effective surface of the mask body by about ⅓ of the width WMH in the long axis of the effective surface, in comparison with that obtained in a conventional color cathode ray tube.

TABLE 2

| | Movement amount (micro m) |
|---|---|
| Embodiment | 290 |
| Prior Art | 355 |

As shown in Table 2, if the color cathode ray tube is constructed as shown in the present embodiment, localized doming can be restricted at a portion where doming easily occurs in a conventional color cathode ray tube, so that the color cathode ray tube is difficult to cause deterioration of color purity.

Industrial Applicability

The inner surface of an effective portion of a substantially rectangular panel is formed in form of a curved surface which satisfies a relationship expressed by the following formulas, where RyP0 is a radius of curvature in the short axis direction, at the center of the effective portion; RyPH is a radius of curvature in the short axis direction, at an end of the long axis of the effective portion; RyP1 is a radius of curvature in the short axis direction within a range of 7/16·WPH to ¼·WPH from the center P0 of the effective surface where WPH is a width of the effective surface in the long axis direction, e.g., at a position P1 on the long axis which is distant by ⅓·WPH; and RyP2 is a radius of curvature in the short axis direction at an end of the effective portion on a line parallel to the short axis passing through the position on the long axis within the range of 7/16·WPH to ¼·WPH from the center P0 of the effective surface.

$RyP1<RyP0$ $RyP1<RyPH$ $RyP1<\frac{1}{2}\cdot RyP2$ $RyP2<3\cdot RyP1$

Further, an effective surface of a shadow mask is formed in a curved surface corresponding to the shape of the inner surface of the panel, and is also formed so as to satisfy a relationship expressed by the following formulas, where RyM0 is a radius of curvature in the short axis direction at the center of the effective surface; RyM1 is a radius of curvature in the short axis direction within a range of $\frac{7}{16}\cdot WMH$ to $\frac{1}{4}\cdot WMH$ where WMH is a width of the effective surface in the long axis direction; and RyM2 is a radius of curvature in the short axis direction an end of the effective portion on a line parallel to the short axis passing through the position on the long axis within a range of $\frac{7}{16}\cdot WMH$ to $\frac{1}{4}\cdot WMH$ from the center M0 of the effective surface.

$RyM1<RyM0$ $RyM1<RyMH$ $RyM1<RyM2$

Then, the distance between the inner surface of the effective portion of the panel and the effective surface of the mask body can be maintained within a tolerable range, and the radius of curvature RyM1 in the short axis direction at a position M1 on the long axis, in which localized doming easily occurs and which is apart from the center M0 of the effective surface of the mask body, by a distance ranging from $\frac{7}{16}\cdot WMH$ to $\frac{1}{4}\cdot WMH$ of the effective surface in the long axis, can be smaller than the radius of curvature in the short axis direction at another portion than the position M1. As a result, it is possible to obtain a shadow mask which is difficult to cause doming, so that a color cathode ray tube which is difficult to cause deterioration of color purity can be constructed.

What is claimed is:

1. A color cathode ray tube comprising:

a rectangular panel including an effective portion having an inner surface in form of a curved surface;

a phosphor screen provided on the inner surface of the panel; and a substantially rectangular shadow mask provided to be opposed to the phosphor screen, characterized in that the inner surface of the effective portion is formed in a curved surface which satisfies relationships of $RyP1<PyP0$ $RyP1<RyPH$ $RyP1<\frac{1}{2}\cdot RyP2$ and $RyP2<3\cdot RyP1$, where RyP0 is a radius of curvature of the inner surface in a short axis direction thereof at the center of the effective portion, RyPH is a radius of curvature of the inner surface in the short axis direction at an end of a long axis of the effective portion, WPH is a width of the effective portion, RyP1 is a radius of curvature of the inner surface of the effective portion of the panel in the short axis direction at a position which is on a line parallel to a short axis of the effective portion and which passes through a position within a range of $\frac{7}{16}\cdot WPH$ to $\frac{1}{4}\cdot WPH$ from a center of the effective portion in the long axis direction, and RyP2 is a radius of curvature of the inner surface in the short axis direction at an end of the effective portion on a line which is parallel to the short axis and which passes through a position within the range of $\frac{7}{16}\cdot WPH$ to $\frac{1}{4}\cdot WPH$ in the long axis direction.

2. A color cathode ray tube according to claim 1, wherein an effective surface of the shadow mask is formed in a curved surface which satisfies relationships of $RyM1<PyM0$ $RyM1<RyMH$ and $RyM1<RyM2$ where RyM0 is a radius of curvature of the effective surface of the shadow mask in a short axis direction thereof at a center of the effective surface, RyM1 is a radius of curvature of the effective surface in the short axis direction at an intermediate portion distant from the center of the effective surface by a distance ranging from $\frac{7}{16}\cdot WMH$ to $\frac{1}{4}\cdot WMH$ in the long axis direction, wherein WMH is a width of the effective surface in a long axis direction thereof, and RyM2 is a radius of curvature of the effective surface in the short axis direction at an end of the effective surface on a line which is parallel to a short axis of the effective surface and which passes through a position in the intermediate portion distant from the center of the effective surface by the distance ranging from $\frac{7}{16}\cdot WMH$ to $\frac{1}{4}\cdot WMH$.

3. A color cathode ray tube comprising:

a rectangular panel including an effective portion having an inner surface in form of a curved surface;

a phosphor screen provided on the inner surface of the panel; and a substantially rectangular shadow mask provided to be opposed to the phosphor screen and having an effective surface in form of a curved surface opposed to the phosphor screen, characterized in that the inner surface of the effective portion is formed in a curved surface which satisfies relationships of $RyP1<PyP0$ $RyP1<RyPH$ $RyP1<\frac{1}{2}\cdot RyP2$ and $RyP2<3\cdot RyP1$, and the effective surface of the shadow mask is formed in form of a curved surface corresponding to a shape of the inner surface of the panel, where RyP0 is a radius of curvature of the inner surface in a short axis direction thereof at the center of the effective portion, RyPH is a radius of curvature of the inner surface in the short axis direction at an end of a long axis of the effective portion, RyP1 is a radius of curvature of the inner surface of the effective portion of the panel in the short axis direction at a position within a range of $\frac{7}{16}\cdot WPH$ to $\frac{1}{4}\cdot WPH$ from a center of the effective portion in the long axis direction, wherein WPH is a width of the effective surface in a long axis direction thereof, and RyP2 is a radius of curvature of the inner surface in the short axis direction at an end of the effective portion on a line which is parallel to the short axis and which passes through a position within the range of $\frac{7}{16}\cdot WPH$ to $\frac{1}{4}\cdot WPH$ in the long axis direction.

* * * * *